US006823545B1

(12) United States Patent
Davis

(10) Patent No.: US 6,823,545 B1
(45) Date of Patent: Nov. 30, 2004

(54) BACK SUPPORT SYSTEM

(75) Inventor: Edmund Scott Davis, Ft. Lauderdale, FL (US)

(73) Assignee: Banyan Licensing LC, Ft. Lauderdale, FL (US)

( * ) Notice: Subject to any disclaimer, the term of this patent is extended or adjusted under 35 U.S.C. 154(b) by 0 days.

(21) Appl. No.: 10/439,725

(22) Filed: May 16, 2003

(51) Int. Cl.[7] ..... A47C 20/00

(52) U.S. Cl. ..... 5/630; 5/632; 5/633; 5/652; 5/657

(58) Field of Search ..... 5/630, 632–634, 5/652, 657

(56) References Cited

U.S. PATENT DOCUMENTS

| | | | | | |
|---|---|---|---|---|---|
| 3,469,882 | A | | 9/1969 | Larsen | |
| 3,742,526 | A | | 7/1973 | Lillard | |
| 3,902,759 | A | | 9/1975 | Monteforte et al. | |
| 4,171,549 | A | * | 10/1979 | Morrell et al. | 5/632 |
| 4,473,913 | A | * | 10/1984 | Ylvisaker | 5/657 |
| 4,635,306 | A | * | 1/1987 | Willey | 5/632 |
| 4,777,678 | A | * | 10/1988 | Moore | 5/657 |
| 4,802,249 | A | * | 2/1989 | Bills | 5/420 |
| 4,853,993 | A | | 8/1989 | Walpin et al. | |
| 4,905,330 | A | | 3/1990 | Jacobs | |
| 4,970,742 | A | | 11/1990 | Keener | |
| 4,987,625 | A | * | 1/1991 | Edelson | 5/657 |
| 5,448,790 | A | * | 9/1995 | Saro et al. | 5/657 |
| 6,270,155 | B1 | | 8/2001 | Rashid | |

* cited by examiner

*Primary Examiner*—Michael Trettel
(74) *Attorney, Agent, or Firm*—Alston & Bird LLP

(57) ABSTRACT

There is provided a back support system of three foam members serving as a piece of recreational or therapeutic furniture. The three foam support members each have a generally rectangular shape when viewed from above and a triangular shaped when viewed from their sides and vary in size. The unique triangular shape of each of the three members enables the pieces to be assembled in a variety of positions depending upon the desires of the user. For example, one of the triangular pieces may be positioned to fit underneath the back and head area of the user while the second member may be placed under the legs of the user to lift the knee area and the third and smallest member may be placed under the lower leg area to keep the feet in an elevated position. Each cushion is made of a resilient foam polymeric material that is covered with a protective fabric. When positioning the members, the members may be held in place by fabric hinges have various widths and zippers incorporated therein to allow the three pieces to be used separately or together. When the three members are folded to nest together, a unitary object is formed for easy shipment or storage.

9 Claims, 4 Drawing Sheets

BACK SUPPORT SYSTEM

BACKGROUND OF THE INVENTION

1. Field of the Invention

The present invention relates generally to a back support system for maintaining a person in a variety of positions on a generally horizontal surface. More specifically, the therapeutic back support system comprises three separate foam members that may be positioned in different ways to provide the support for a user's back and neck and/or feet.

2. Description of Related Art

Many people are restricted by back pain and find comfort in lying in a supine position that supports the spine and neck in a flexed position. To provide comfortable back support, utilizing various combinations of cushions and pillows has become customary. Although such combinations occasionally provide some back support, they are often cumbersome, unwieldy and usually of limited therapeutic effectiveness. In addition, many people spend time lying on their backs while watching television or reading and desire support for their back. There are numerous variations of back supports, which are adapted to various uses ranging from recreational furniture to more formal structured therapeutic devices. Many of these furniture pieces can be folded into a compact shape for storage or transport.

An example of recreational furniture is shown in U.S. Pat. No. 3,469,882 to Larson, wherein there is disclosed a piece of furniture having a cylinder shape when placed in a folded position. The disclosure illustrates several embodiments using a different number of cushions that are pivotally interconnected along an edge. The cushions may be placed in relation to each other such that one of the cushions constitutes a seat abutting the floor while another cushion may be a backrest. The backrest may be divided into two cushions that are hinge connected with each other at the top of the backrest so that they may be swung out to form a lying surface. The backrest has a substantially planar front side and a curved rear side with the greatest thickness at the middle. The cushions are hinged together by using one continuous piece of material and thus the cushions are not interchangeable.

Another example of convertible furniture is shown in the Monteforte patent, U.S. Pat. No. 3,902,759, wherein there is disclosed an easy chair. The easy chair comprises a number of upholstered cushion members of substantially parallelepiped configuration. Each of the members is interconnected by a hinge to its adjacent member at a seam line running along horizontal corner edges of the confronting parallelepiped faces. The dimensions of the cushion members and the hinge connected edges allow the cushions to be folded up. The cushions may be positioned to be converted to different embodiments including, for example, a couch or a bed. However, none of the embodiments provides support for the back and neck or legs.

The Rashid patent, U.S. Pat. No. 6,270,155, discloses a chair made from three foam cushions. One cushion forms a seat having a back and a contoured, concave seat. Attached to the front edge of the seat cushion by an elongated fabric hinge is an arcuate leg rest cushion. The leg rest has a gently contoured, convex side that complements the concave contour of the seat. The opposite side of the leg rest cushion is concavely contoured to complement the upper contour of an ottoman. The ottoman is a separate piece. When folded, the leg rest cushion nestles with the seat cushion, and when the ottoman is placed within the concave contour of the leg rest a cube is formed. Because the chair seat is used as such, it does not provide support to the back and neck or legs of the user.

U.S. Pat. No. 4,987,625 to Edelson discloses a multi-membered support device that may be adapted to provide head and body support for persons working or resting in prone, supine or other positions. A primary wedge-shaped upper-body cushion is joined at its thick end by hinged means to a smaller parallelepiped shaped head cushion that may pivot so as to lie either on top, or in front of the inclined upper surface of the primary cushion. The cushions of the support device are flexibly attached in a collapsible unitary structure, which may be easily adjusted to provide head and body support for persons.

Despite the various forms of recreational and therapeutic furniture, there remains a desire for a back support system of the type described by the present invention that provides a number of different positions that support the back and neck or legs of the user.

SUMMARY OF THE INVENTION

It is, therefore, an object of the invention is to provide a piece of furniture that serves as a back support system that may be positioned to support a user in a variety of positions that provides beneficial support and comfort to the back and neck, and legs and feet when the user is in a reclined position.

An additional object of the present invention is to provide a three member back support system of triangular shaped foam cushions that may be folded to nest together into a single unit for storage or easily transported.

It is another object of this invention is to provide a three member back support system wherein the members may be placed in various positions and are connectable to each other.

The present invention is a back support system of three foam members serving as a piece of recreational or therapeutic furniture. The foam members are covered with fabric to provide a comforting "zero gravity" position. The three foam support members have a generally rectangular shape when viewed from above and a triangular shaped when viewed from their sides. Each of the three cushions varies in size. The unique triangular shape of each of the three members enables the pieces to be assembled in a variety of positions depending upon the desires of the user. For example, one of the triangular pieces may be positioned to fit underneath the back and head area of the user while the second member may be placed under the legs of the user to lift the knee area and the third and smallest member may be placed under the lower leg area to keep the feet in an elevated position.

Each cushion is made of a resilient foam polymeric material that is covered with a protective fabric. When positioning the members under a user, the members may be held in place relative to each other by fabric hinges. These fabrics are of various widths and have zippers incorporated within to allow the three members to be spaced and maintained apart at different intervals or used separately. When the three members are folded to nest together, a unitary object is formed for easy shipment or storage.

Other objects, features and advantages of the present invention will become apparent from the following detailed description of the invention taken in conjunction with the accompanying drawings.

BRIEF DESCRIPTION OF THE DRAWINGS

Figure 1:
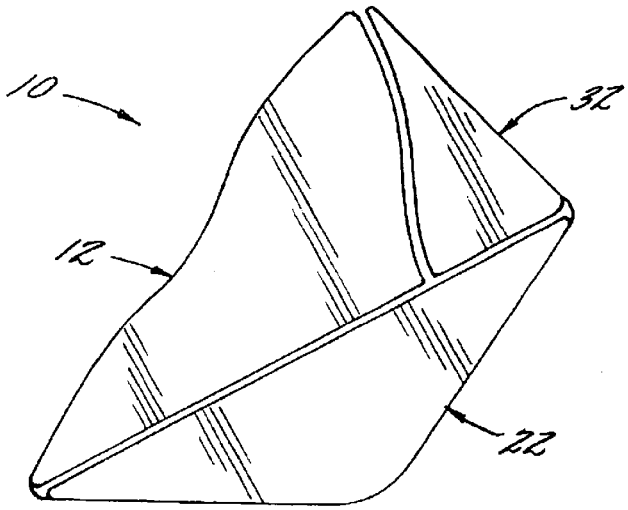
Figure 2:
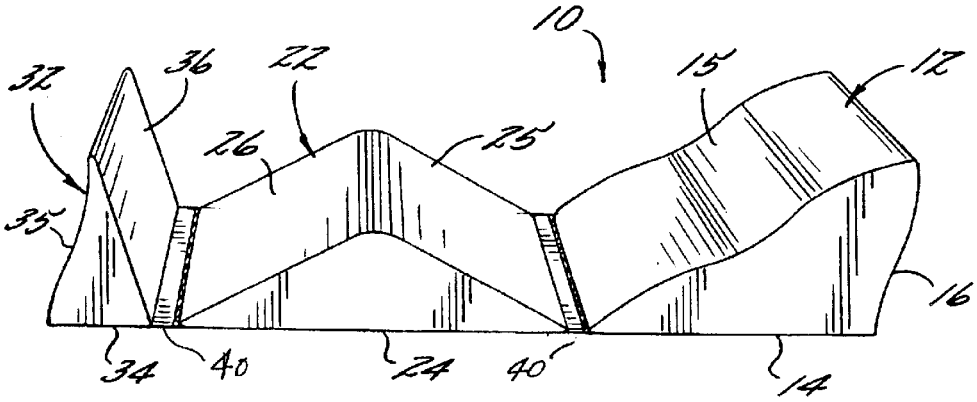
Figure 3:
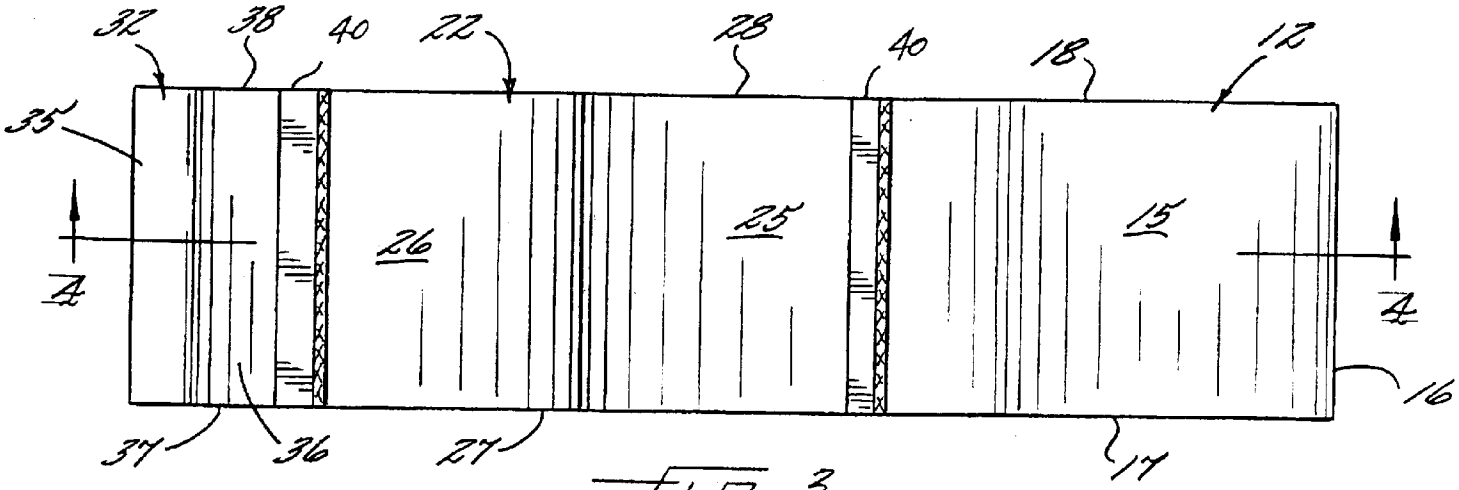
Figure 4:
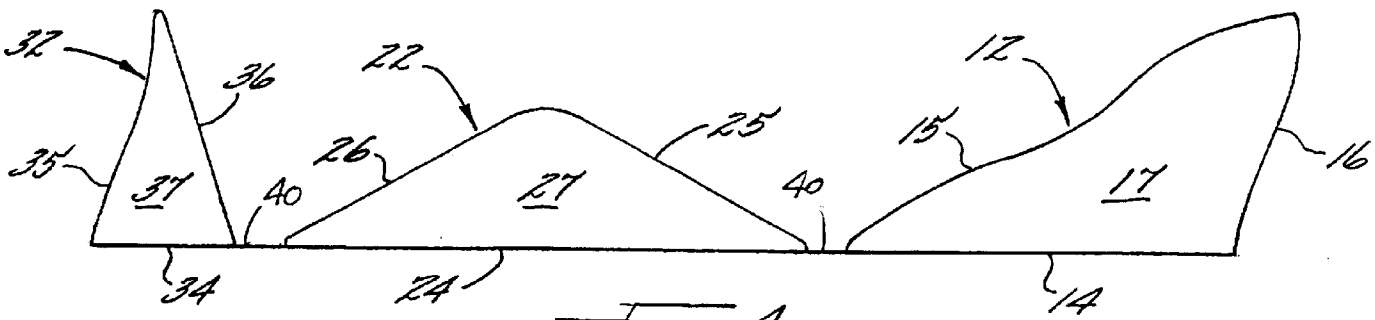
Figure 5A:
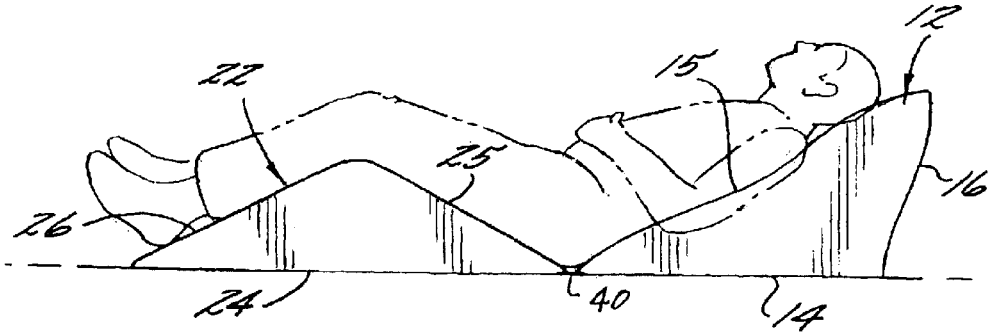
Figure 5B:
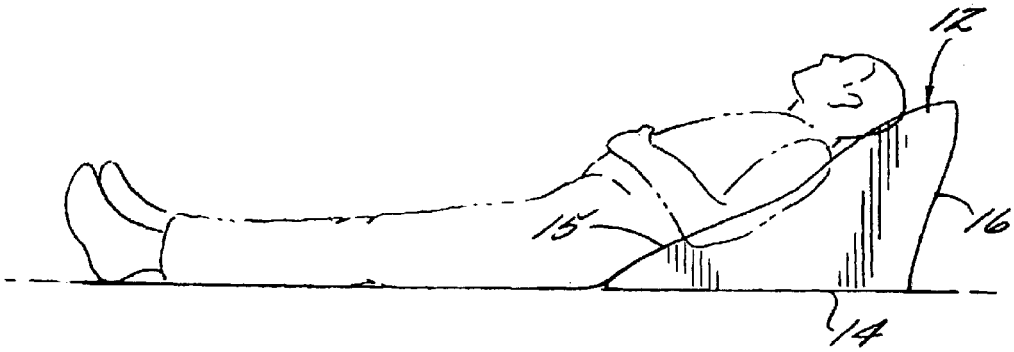
Figure 5C:
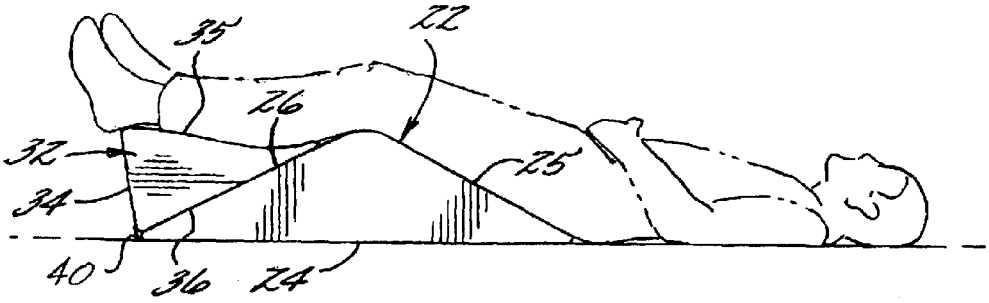
Figure 5D:
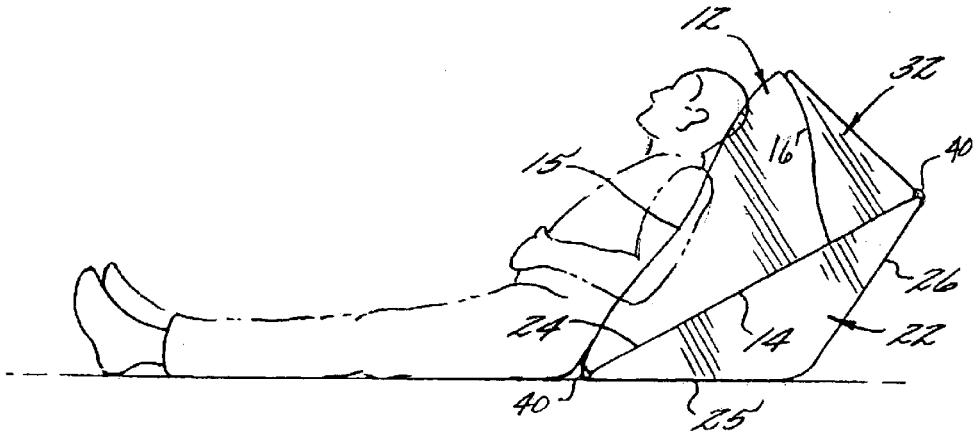
Figure 5E:
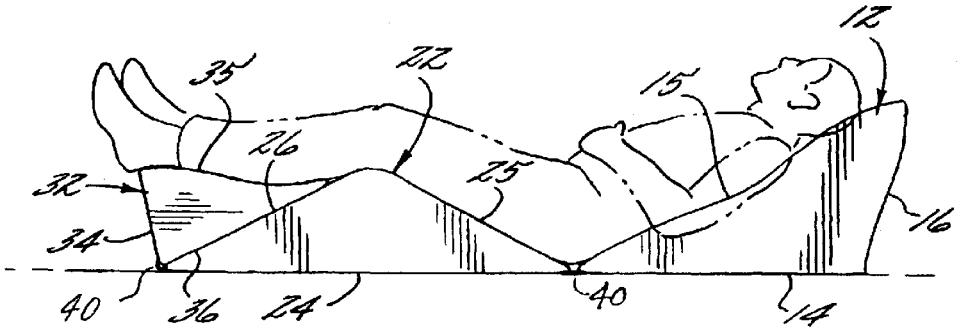
Figure 5F:
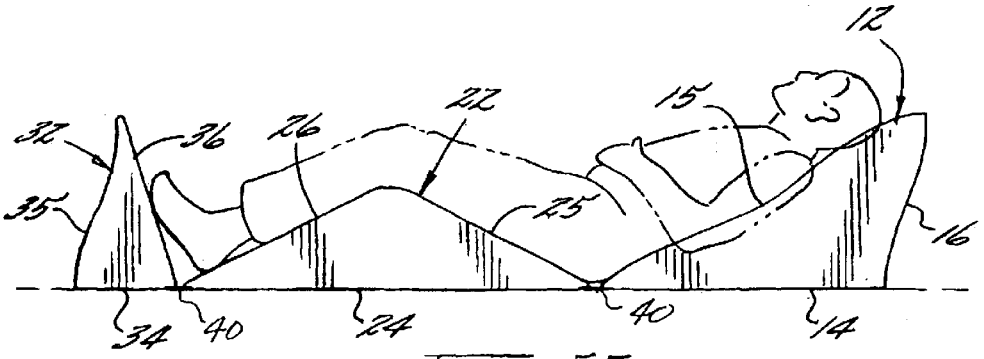

Having thus described the invention in general terms, reference will now be made to the accompanying drawings, which are not necessarily drawn to scale, and wherein:

FIG. 1 is a side view of a preferred embodiment of the support members of the back support system of the present invention illustrating the members of the back support system nested together into a single unit for storage and easy transportation;

FIG. 2 is a perspective view of the a preferred embodiment of the back support system of the present invention showing the support members arranged in an open position for support of the user's back and neck as well as legs and feet, such as that shown in FIG. 5;

FIG. 3 is a top view of the three members of the back support system of the present invention placed on a horizontal surface so the user may comfortably lie thereon;

FIG. 4 is a cross sectional view of the triangular shaped members of the back support system taken along line 44 of FIG. 3;

FIG. 5A is an embodiment of the back support system of the present invention showing two of the members arranged under the back/head and legs of a reclined user, FIG. 5B is another embodiment of the back support system of the present invention showing placement of only one member under the back/neck and head of a reclined user;

FIG. 5C is yet another embodiment of the back support system of the present invention showing of two of the members under the legs and feet of a user reclining on a horizontal surface;

FIG. 5D shows a use of the back support system of the present invention in a closed or nested position supporting the back and head of the user;

FIG. 5E shows an embodiment of the back support system of the present invention utilizing the three members in a manner to support the back and to keep the feet in a raised position; and FIG. 5F shows yet another way to position the three members of the back support system of the present invention to provide support for the back and head, and legs and feet of the user.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring more particularly to the drawings, FIG. 1, shows the back support system 10 of the present invention. As shown, the back support system is in its folded position to nest together making it easy to store or transport. As shown in FIG. 2, the back support system includes a first foam support member 12, a second foam support member 22 and a third foam support member 32. The back support system is used in its open position wherein the members 12, 22, and 32 are arranged in various positions on a generally horizontal surface such as a floor or bed. As seen most clearly in the embodiments of FIGS. 5A–5F the back support system provides therapeutic support when used on a generally horizontal surface.

As shown in the top view of the preferred embodiment of FIG. 3 the three support members have generally rectangular faces when viewed from above. Support member 12 includes a rectangular bottom 14, a rectangular top face 15, a rectangular back face 16, and a pair of parallel sides 17, 18. Each of the sides has a triangular shape as can be seen best in FIG. 4. In a preferred embodiment, support member 12 is placed to support the back, neck and head of the user. While it is preferred that the support members have rectangular faces, it should be understood that the term "generally rectangular" includes support member faces that may be curved on one or more sides.

Also as shown in FIG. 3, a second foam support member 22 is provided. This support member has generally rectangular faces when viewed from above, e.g., bottom face 24, a first top face 25, and a second top face 26. A pair of parallel sides 27, 28, each side having a triangular a shape is shown in FIG. 4. In a preferred embodiment, first face 25 and second face 26 form the sides of an isosceles triangle. Member 22, in most embodiments, is placed beneath the legs of the user.

A third foam support member 32 having rectangular faces is provided. When viewed from above, the third member 32 has a bottom face 34, a first top face 35 and, a second top face 36. Member 32 also includes a pair of parallel sides 37, 38 that form a triangular shape and preferably form an acute triangle. Member 32 is usually smaller than the other members. Member 32 is most often used to support the feet or legs of the user.

Each support member is made of a resilient foam rubber material such as those conventionally used for cushions. The support members are preferably covered with a fabric. The removable cover of fabric surrounds each member to protect and adorn it. The fabric and its pattern are chosen from aesthetic considerations to fit the environment of its intended use. The fabric can be changed to provide the support system 10 with a new look.

To prevent the members from moving away from each other when in use the members are pivotally interconnected along at least one edge of the fabric on each support member. The interconnection is made at fabric hinge 40. The pivotal hinge 40 sufficiently wide to allow positioning of the members to accommodate both taller and shorter people or those with different body dimensions. As used herein the width of the hinge 40 is the distance between the members that the hinge connects. The hinge may include a zipper, VELCRO® fastener or the like for separating and joining the members.

Each support member may be placed in operative positions adjacent each other in such manner that at least the rectangular face of the first support member supports the user's back or if desired, another member just supports the legs and feet. In FIGS. 5A–5F there is shown several embodiments of some of the various positions in which the members of the back support system may be placed to support different parts of a user's body. In a first embodiment, there is shown in FIG. 5A the use of two members of the back support system. The first member 12 is placed under the back, neck and head of the user with face 14 resting on a horizontal surface and the user's back, neck and head resting on face 15. The second member 22 is placed under the knees of the user with the user's thigh and calf resting on top faces 25 and 26. This position relieves stress to the lower back and neck areas as well as the legs. The members 12 and 22 may be connected by hinge 40 to maintain the members in proper relationship to each other. The width of the hinge may be varied depending upon the height of the user.

FIG. 5B is another embodiment of the back support system of the present invention showing placement of only member 12 under the head of a reclined user. Member 12 is placed under the back, neck and head of the user with face 14 resting on a horizontal surface and the user's back, neck and head resting on face 15.

There is shown in FIG. 5C an embodiment of the back support system designed to relieve stress under the legs and feet of the user. This embodiment uses member 24 and member 34 for that purpose. The thighs of the user rest on the top face 25 of the member 24. Member 32 rests on face 26 of member 24 and the calves and feet of the user rest on face 35 of member 32. By raising the legs and feet stress is also relieved on the lower back area. Member 32 is prevented from shifting by hinge 40.

FIG. 5D shows the three members of the back support system in a closed or nested position supporting the back and head of the user. In this embodiment member 12 is placed on face 24 of member 22. Member 32 is placed within the void created by face 16 of member 12 and a portion of face 24 of member 22. The members are maintained in place by the hinges 40. Because the back is supported by both members 12 and 22, the back is raised higher than when member 12 is used alone.

In FIG. 5E there is shown an embodiment of the back support system utilizing the three members in a manner to both support the back and neck and to keep the feet in a raised position. Member 12 is placed under the back and neck with the user resting the back and neck on face 15 of member 12. Members 24 and 34 are placed under the legs and feet in the manner of FIG. 5C. The members are prevented from moving by hinge 40.

FIG. 5F shows yet another way to position the three members of the back support system to provide support for the back and head, and legs and feet of the user. In this embodiment member 12 is placed under the head and neck of the user as in FIG. 5E. Member 24 is placed under the legs in the manner described in FIG. 5A. Member 34 is placed at the feet of the user so that the sole of the foot is pressing on face 36. Member 34 is maintained in the upright position by hinge 40.

The unique overall design of the present invention provides support that allows the user to rest more comfortably on a horizontal surface by allowing the muscles to relax, while relieving the spine from weight bearing stresses. This can be very beneficial to people with back and neck pain. It should be understood that other embodiments may be readily envisioned by those skilled in the art.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A back support system for use on a generally horizontal surface for supporting a portion of a person comprising a first foam support member having generally rectangular faces when viewed from above and a pair of sides having a triangular shape;

a second foam support member having generally rectangular faces when viewed from above and a pair of sides having a triangular shape;

a third foam support member having generally rectangular faces when viewed from above and a pair of sides having a triangular shape;

each support member being covered with fabric and placeable in operative positions adjacent each other in such manner that at least one rectangular face of said first support member supports the user's back, wherein at least one edge of the fabric on each support member is capable of being pivotally interconnected alone an edge to an adjacent support member through a hinge member, and wherein the three support members may be folded together to form a unitary object, said unitary object being maintained in a unitary position by said interconnections.

2. The system of claim 1 wherein each of said foam support members are made of resilient foam polymeric material.

3. The system of claim 1 wherein said adjacent support members are interconnected with a zipper.

4. The system of claim 1 wherein the interconnections at each hinge member are of varying widths.

5. The system of claim 1 wherein at least one of said foam members forms an isosceles triangle.

6. A back support system for use on a generally horizontal surface for supporting a portion of a person comprising a first foam support member having generally rectangular faces when viewed from above and a pair of sides having a triangular shape;

a second foam support member having generally rectangular faces when viewed from above and a pair of sides having a triangular shape;

a third foam support member having generally rectangular faces when viewed from above and a pair of sides having a triangular shape;

each support member being covered with fabric and placeable in operative positions adjacent each other in such manner that at least one rectangular face of said first support member supports the user's back, wherein at least one edge of the fabric on each support member is capable of being pivotally interconnected with a zipper along an edge to an adjacent support member through a hinge member, and wherein the three support members may be folded together to form a unitary object, said unitary object being maintained in a unitary position by said interconnections.

7. The system of claim 6 wherein each of said foam support members are made of resilient foam polymeric material.

8. The system of claim 6 wherein the interconnections at each hinge member are of varying widths.

9. The system of claim 6 wherein at least one of said foam members forms an isosceles triangle.

* * * * *